United States Patent [19]

Oliver

[11] Patent Number: 4,530,223

[45] Date of Patent: Jul. 23, 1985

[54] GUARD FOR KEY CYLINDER

[75] Inventor: Roy N. Oliver, Salem, Va.

[73] Assignee: Medeco Security Locks, Inc., Salem, Va.

[21] Appl. No.: 438,373

[22] Filed: Nov. 1, 1982

[51] Int. Cl.[3] ..... E05B 63/00

[52] U.S. Cl. ..... 70/417; 70/448; 70/452

[58] Field of Search ..... 70/417, 451, 452, 448, 70/370, 371, 372

[56] References Cited

U.S. PATENT DOCUMENTS 3,768,284 10/1973 Kent ..... 70/417

4,296,619 10/1981 Widen ..... 70/451

4,316,371 2/1982 Del Nero ..... 70/417

*Primary Examiner*—Robert E. Wolfe

*Attorney, Agent, or Firm*—Bernard, Rothwell & Brown

[57] ABSTRACT

A rim cylinder protection unit includes a single flat thick solid hardened steel guard plate counterbored to receive the rim of the cylinder. The cylinder is secured to the plate and prevented from rotation by cooperation with a cylinder retaining plate attached to the backside of the guard plate. The thick solid steel guard plate has heavy mounting studs welded by hardened material to the plate to extend through the door and these studs are protected by hardened steel sleeves to prevent burglars from chiseling through the studs. A replaceable cover conceals the rugged steel guard plate.

12 Claims, 3 Drawing Figures

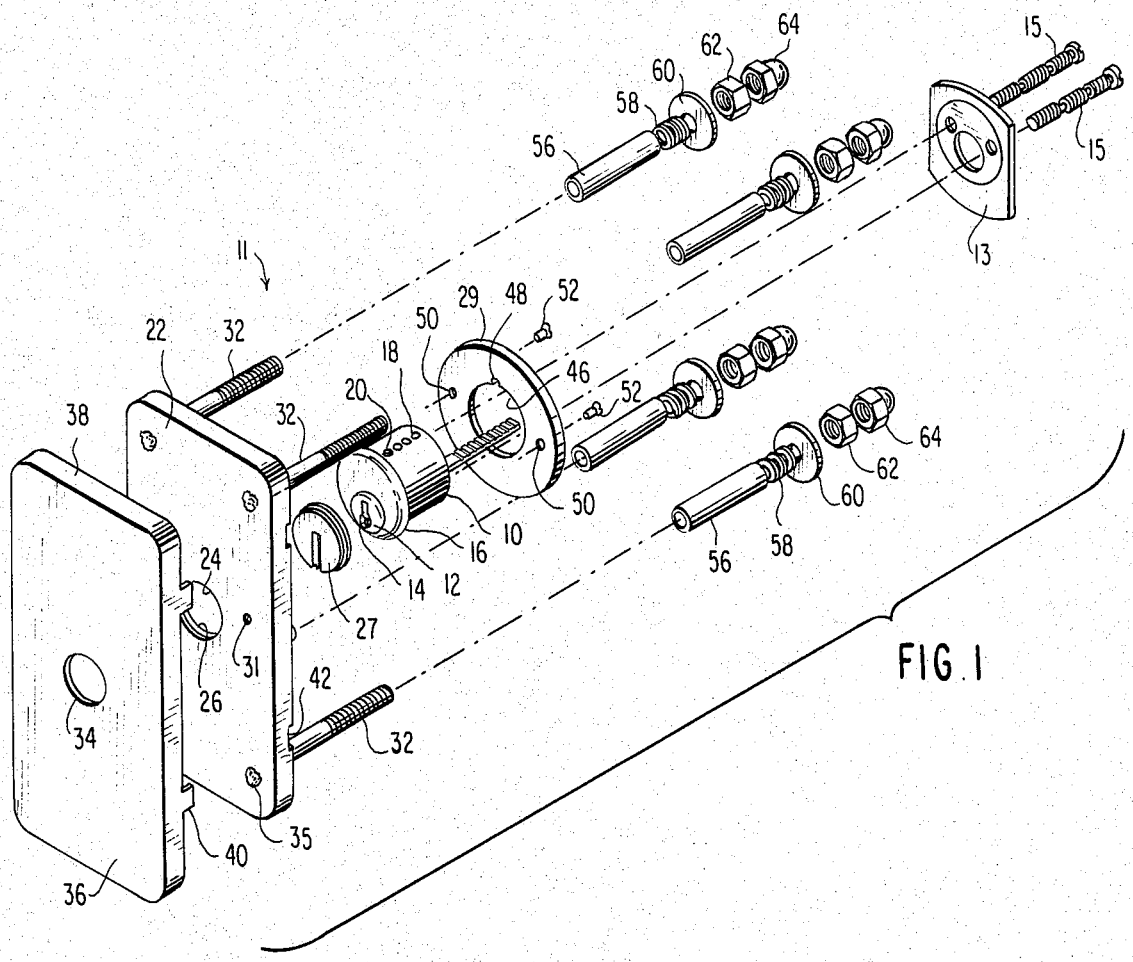
FIG. 1
FIG. 2
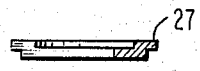
FIG. 3
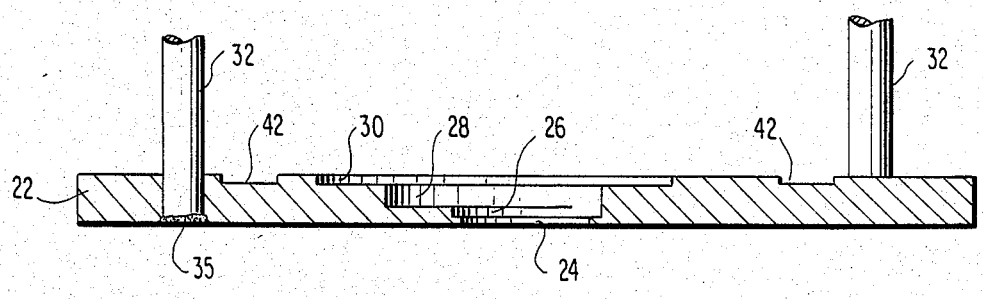

GUARD FOR KEY CYLINDER

BACKGROUND OF THE INVENTION

1. Field of the Invention

This invention relates to improvements in guard plates for rim cylinder locks.

2. Prior Art

For over fifty years workers in the art have been attempting to prevent cylinder locks from being defeated or violated by drilling, forcing, wrenching or pulling the cylinder. For early efforts in this regard see the patents to Phillips U.S. Pat. No. 1,979,139 (1926), Maxwell U.S. Pat. No. 1,579,126 (1926). Other workers in the art have continued to date with various arrangements of cylinder lock protectors none of which have been particularly successful commercially. Representative efforts are shown in the following U.S. Pat. Nos.: 3,083,563 (1963), 3,260,081 (1966), 3,550,411 (1970), 3,645,045 (1972), 3,768,284 (1973) 3,795,123 (1974), 4,041,741 (1977), 4,073,172 (1978), 4,139,999 (1979), 4,160,368 (1979), 4,237,712 (1980), 4,316,371 (1982). Even the most rugged cylinder guard can be defeated if the mounting means, e.g. bolts through the door, can be severed, or drilled out.

Commercially available guards include steel plates which are bolted over exposed faces of the cylinders leaving the cylinder plugs exposed through holes in the plates. These plates can be readily removed by chiseling or drilling the bolt heads or the bolt shanks. One prior art type of guard employs laminated plates with the bolt heads sandwiched between inner and outer plates and the outer plate hardened to prevent drilling. However, the laminated plates can be chiseled or peeled apart exposing the bolt heads, or the bolt shanks may be chiseled beneath the plates to remove the guard.

There is need in the art for a simple yet extremely rugged armored protective plate for shielding and protecting a rim cylinder lock from the outside which protects the lock cylinder itself and also has means to prevent the protective plate from being defeated by drilling or chiseling the mounting bolts.

SUMMARY OF THE INVENTION

This invention provides a unique rugged protection assembly for rim cylinder locks with means for protecting the protection assembly. The assembly includes an extremely rugged solid steel protective plate with mounting studs welded to it in a manner such that the welds, being extra hard, prevent the studs from being drilled out. A replaceable cover plate which has a decorative finish hides the location of welded studs. A hardened cylinder protector disc is positioned in front of and protects the cylinder plug. A retaining plate with a slot for cooperation with a set screw on the cylinder is attached to the back of the protective plate. Each of the mounting studs is protected by hardened steel sleeves to protect them against chisel attack. Variations in door thickness can be accommodated by spacers for the mounting studs.

BRIEF DESCRIPTION OF THE DRAWINGS

FIG. 1 is an exploded perspective view of a door lock assembly in accordance with the invention.

FIG. 2 is a section view of a cylinder plug protector in the assembly of FIG. 1.

FIG. 3 is a section view of a portion of a protective plate in the assembly of FIG. 1.

DETAILED DESCRIPTION OF THE PREFERRED EMBODIMENT

As illustrated in FIGS. 1, 2 and 3, one preferred embodiment of the invention is in the form of a key cylinder assembly including a key cylinder 10 and guard facilities indicated generally at 11 for protecting the cylinder. The assembly is designed to be installed in a door where the cylinder 10 operates a lock mechanism (not shown), and the guard facilities 11 prevent the cylinder from being attacked to defect the lock mechanism. However, the assembly may be installed in many other devices or locations and may be used to operate or control other mechanisms.

The lock cylinder 10 may be of the high security type shown in U.S. Pat. No. 3,499,302 and as made and sold by Medeco Security Locks, Inc. of Salem, Virginia. Such high security lock cylinder, although virtually pick proof, could be subject to break-ins by drilling, forcing, wrenching or pulling the cylinder unless the cylinder is protected. The lock cylinder 10 has a plug 12 with a key way 14 therein for an appropriate key. A cylinder rim 16 protrudes outwardly from the body of the cylinder and has a backside flange which in the absence of the guard facilities 11 would normally fit against the flat surface (e.g. the face of a door) surrounding a hole drilled for the cylinder. A conventional plate 13 and screws 15 are provided for fastening the cylinder in the door. This cylinder is the commercially available Medeco high security lock cylinder. The cylinder 10 has a plurality of set screws 18 in the tumbler bores above the tumblers in the cylinder and in the present construction the set screw closest to the front flange, set screw 20, is longer than the others so it projects above the surface of the cylinder and is used to prevent turning of the cylinder.

The cylinder 10 when installed in a door is protected by a massive solid steel guard or protective plate 22 having a circular opening 24 therethrough over the plug 12. This opening 24 is slightly larger than the plug 12. The back of the opening has three cylindrical recesses or counterbores. The deepest recess 26 is concentric with the plug 12 and opening 24 and accommodates a rotatable hardened steel cylinder plug protector 27. The next recess 28 is concentric with and of a size to accommodate the face and rim 16 of the cylinder and hence is on a different center or eccentric from the recess 26. The third, or shallowest recess 30 is concentric with the cylinder accommodating recess 28 but has a larger diameter for accommodating a cylinder retaining plate 29. This third recess 30 has a pair of threaded holes 31 in it at opposite sides.

The solid steel protective plate 22 may be manufactured from 5/16 inch thick cold rolled steel. A solid plate cannot be peeled off in layers like a laminated plate. The plate has 5/16 inch mounting studs 32 mounted in bores through each corner of surface and attached by welds 35. The welds 35 are formed on recessed ends of the studs 32 within the corner bores of the plate. The welding material is hardened drill-resistant material which fills the bore recesses in the front face of the plate 22 and extends to areas surrounding the bores to form hardened areas which prevent drilling of the studs. Grinding is employed to make the welds 35 flush with the front of the plate 22. The welds also make the mounting studs 32 and the plate 22 one solid unit.

A replaceable decorative cover plate 36 has a hole 34 therethrough concentric with and slightly smaller than hole 24. The cover plate 36 has inwardly turned peripheral edges 38 which cover the edges of the guard plate 22. Bendable attaching tangs 40 may be bent into grooves 42 in the back of the plate 22 for the purpose of holding the cover plate. The cover plate may be solid brass with various finishes and may contain a suitable name or trademark. It completely conceals the protective plate 22 and the stud welds 35.

The lock cylinder 10 is mounted onto the back of guard plate 22 with rim 16 in recess 28 and prevented from rotation by means of a cylinder retaining plate 29 having a circular hole 46 therein sized for receiving the diameter of cylinder 10 with a slot or notch 48 slightly greater than the diameter of set screw 20 so as to fit over this set screw. The cylinder retaining plate has diamerically positioned recessed screw holes 50 so that screws 52 may be threaded through the plate 29 and into the hole 31 in recess 30 in the back of plate 22 to securely retain the cylinder against the back of the guard plate 22 and prevent its rotation.

In the first or deepest recess 26 in the back of plate 22 there is positioned the rotatable hardened steel cylinder plug protector 27. It has a step diameter the outermost diameter of which is the same as the recess 26 and the inner diameter of which is the same as the hole 24 in the plate 22. It can rotate with the key and plug, and its position prevents drilling the plug.

Hardened chisel-resistant sleeves 56 slip over each of the studs 32 to protect the mounting studs from chisel attack. The studs 32 are made of high strength but relatively soft steel which are resistant to breaking but which could be defeated by chiseling were it not for the hardened steel sleeves 56. A plurality of spacers 58 and a washer 60 are provided to adjust for variations in door thickness and to insure that the hardened sleeves are held firmly in place against the protective plate 22. These sleeves 56 and spacers 58 also serve to reinforce the door in metal door applications. The units are also provided with a hexnut 62 for assembly and tightening after which the ends of the mounting studs are cut off, the hexnut removed and an acorn nut 64 applied to the end of each stud to provide a finished job.

The protection plate may be mounted on the door utilizing a drilling template. When mounted over a cylinder it provides a very safe and most reliable way to discourage break-ins and offers substantially improved protection for the rim cylinder for a door lock. The armored plate shields the lock cylinder and defends the cylinder from the outside while the lock protects the door from being opened without a key. The armored plate of 5/16 inch solid steel cannot be peeled or delaminated and is thick enough to discourage burglars from drilling, forcing, wrenching or pulling the cylinder. The replaceable cover plate conceals the rugged steel plate and is available in various finishes to enhance the appearance of the door. The welding of the studs by hardened material in the face of the armored plate and the enclosing of the studs by hardened steel sleeves prevent burglars from drilling or chiseling the studs. The hardened plug protector protects the plug from being drilled or pulled. The entire assembly provides maximum protection for the cylinder.

Since many modifications, changes in detail and variations can be made to the decribed embodiment without departure from the scope and spirit of the invention, it is intended that all matter in the foregoing description and in the accompanying drawings be interpreted as illustrative of the invention and not as limiting the invention.

What is claimed is:

1. An assembly for protecting a rim key cylinder fitted in a door, the assembly comprising;

(a) a flat thick steel protective plate having a hole therethrough for access by a key to a cylinder lock, (b) a plurality of cylindrical recesses in the inside surface of the protective plate around the hole, (c) a plurality of studs welded to the protective plate and extending therefrom on the same side as the recesses, (d) a thin replaceable cover plate fitting over the outside and side surfaces of the protective plate, and having a hole therein in registry with the hole in the protective plate, (e) a hardened steel cylinder plug protector adapted to be rotatably positioned in a deepest of the cylindrical recesses and having a key accommodating slot therein, (f) a cylinder retaining plate adapted to be positioned in the shallowest of the cylindrical recesses and having means for cooperating with a lock cylinder to prevent relative rotation, (g) means for securing the cylinder retaining plate to the protective plate in the shallowest of the cylindrical recesses, (h) hardened steel sleeves, one for each stud, adapted to be positioned over each stud, and (i) means for cooperating with the free ends of the studs for attaching the assembly to the door.

2. An assembly as defined in claim 1 wherein there are three cylindrical recesses, the deepest for the hardened steel cylindrical plug, the shallowest for the cylindrical retaining plate, and the intermediate one for the rim of the cylinder.

3. An assembly as in claim 1 wherein the welds attaching the studs to the protective plates are tool steel welds which harden the plate and wherein the cover plate completely covers the welds.

4. An assembly as in claim 1 wherein the cylinder retaining plate cooperating with the cylinder lock to prevent rotation is an annular disc and includes a slot on the inside of the hole in the disc, the slot being of a size complimentary to a means projecting from the surface of the cylinder lock.

5. An assembly as in claim 4 wherein the means projecting from the surface of the cylinder lock is a set screw above a tumbler adjacent to the cylinder rim.

6. An assembly as in claim 1 wherein the length of the hardened steel sleeves is approximately the thickness of the door.

7. An assembly as in claim 6 further comprising spacers positionable on the studs to accommodate different thickness doors.

8. An assembly as in claim 1 wherein the means for cooperating with the free ends of the studs are nuts.

9. An assembly as in claim 1 wherein the protective plate has grooves in the back thereof, and the cover plate has tangs bendable into the grooves on the back of the protective plate.

10. The combination of a rim cylinder lock and a protective assembly for protecting the lock when installed in a door, comprising;

(a) a rim cylinder lock having a mounting flange rim, a rotatable plug, and an elongated set screw in a tumbler spring hole nearest the rim, the set screw projecting above the surface of the cylinder, (b) a thick flat steel protective plate having a hole therethrough for access to the cylinder plug and having recess means in an inner face thereof, (c) a plurality of studs welded to the protective plate and extending from the inner surface thereof a distance at least equal to the thickness of the door, the studs and plate forming a solid unitary construction, (d) a removable cover plate covering the outer face and sides of the protective plate and having a hole therethrough and registry with the hole through the protective plate, (e) a cylinder plug protector disc having a key slot therein positioned in the recess means, (f) means holding the flange rim of the rim cylinder lock in the recess means behind the cylinder plug protector disc and for preventing rotation of the cylinder lock relative to the protective plate.

11. The combination as recited in claim 10 wherein the last recited means comprises, an annular cylinder retaining plate fitting over the cylindrical body of the cylindrical lock and fitting within the recess means behind the flange of the cylinder lock, and having a slot therein to allow the elongated set screw to pass therethrough.

12. The combination of a rim cylinder lock and a protective plate for protecting the lock when installed in a door, comprising:

(a) a rim cylinder lock having a mounting flange rim, a rotatable plug, and a configuration interrupting the cylindrical surface of the outside of the cylinder body, (b) a thick flat steel protective plate having a hole therethrough for access to the cylinder lock plug, and having first and second recess means in an inner face thereof to be positioned against the door, the first recess means accommodating the mounting flange rim of the cylinder lock, (c) a plurality of studs integrally connected to the protective plate and extending from the inner surface thereof a distance at least equal to the thickness of the door, the studs and plate forming a unitary construction, (d) threaded nuts for the ends of each of the studs to hold the assembly onto the door, (e) retaining plate means secured by screws in the second recess means and cooperating with the configuration interrupting the cylindrical surface of the outside of the cylinder lock for holding the flange rim of the rim cylinder lock in the first recess means and for simultaneously preventing rotation of the cylinder lock relative to the protective plate.

* * * * *